US010807262B1

(12) United States Patent
Willmoth

(10) Patent No.: US 10,807,262 B1
(45) Date of Patent: Oct. 20, 2020

(54) FOOD CUTTING DEVICE WITH DETACHABLE CUTTING WHEEL

(71) Applicant: Bradley S. Willmoth, Percy, IL (US)

(72) Inventor: Bradley S. Willmoth, Percy, IL (US)

( * ) Notice: Subject to any disclaimer, the term of this patent is extended or adjusted under 35 U.S.C. 154(b) by 0 days.

(21) Appl. No.: 16/452,772

(22) Filed: Jun. 26, 2019

(51) Int. Cl.
*B26B 5/00* (2006.01)
*B26B 25/00* (2006.01)
*B26B 29/00* (2006.01)

(52) U.S. Cl.
CPC ..... *B26B 25/005* (2013.01); *B26B 29/00* (2013.01)

(58) Field of Classification Search
CPC ..... B26B 25/005; B26B 29/00
USPC ..... 30/307
See application file for complete search history.

(56) References Cited

U.S. PATENT DOCUMENTS 961,337 A * 6/1910 Bretz ..... B26B 3/04 30/128
963,682 A * 7/1910 Boyer ..... B26B 3/04 30/128
3,286,349 A 11/1966 Larson
4,809,437 A 3/1989 Saliaris
7,188,424 B2 3/2007 Webster et al.
7,290,340 B2 * 11/2007 Lin ..... B26B 25/005 30/292
8,661,693 B2 3/2014 Bagley
8,785,193 B2 * 7/2014 Shin ..... B26B 5/008 435/325
8,826,789 B2 * 9/2014 Bagley ..... B26B 29/06 30/292
2007/0294898 A1 * 12/2007 Beltran ..... B26B 25/005 30/307
2010/0037787 A1 2/2010 Eide et al.
2011/0078908 A1 * 4/2011 Bagley ..... B43L 12/00 30/292
2014/0190020 A1 7/2014 Galster et al.
2014/0298665 A1 * 10/2014 Shin ..... B26B 5/008 30/306
2016/0193741 A1 7/2016 Wong

* cited by examiner

*Primary Examiner* — Omar Flores Sanchez
(74) *Attorney, Agent, or Firm* — Goldstein Law Offices, P.C.

(57) ABSTRACT

A food cutting device with a handle adapted to be held in a user's hand and a detachable cutting wheel for cutting a food item, the detachable cutting wheel has a circular blade and an axle projecting therefrom, the handle has a retaining pincer adapted to grasp the axle, allowing the detachable cutting wheel to freely rotate therein, and has a pincer gap which allows the axle to be alternatively inserted or removed. The axle has a retaining flange positioned parallel to the circular blade, preventing lateral shifting of the detachable cutting wheel by abutment between the circular blade, the retaining flange, and the retaining pincer positioned therebetween. The handle further has an upper blade guard and a lower blade guard adapted to protect the user's hand from the circular blade.

8 Claims, 5 Drawing Sheets

FOOD CUTTING DEVICE WITH DETACHABLE CUTTING WHEEL

TECHNICAL FIELD

The present disclosure relates generally to a device for cutting food. More particularly, the present disclosure relates to a food cutting device having a detachable cutting wheel.

BACKGROUND

Rolling food slicers, such as pizza cutters, are convenient to use and are less hazardous to handle than knives. Pizza cutters utilize circular blades attached to handles, which are rolled across pizza to make long cuts using a combination of the sharp edge and downward pressure. The circular blades of conventional pizza cutters are permanently attached to the handles using various hinge mechanisms, therefore making it difficult to remove food residue such as pieces of crust, sauce, and cheese, which accumulates around the hinges and between the blade and handle in areas which a user cannot directly access.

Examples of food slicers with removable blades may be found within the prior art. However, these devices either employ hinges with removable locking pins which are difficult to remove and reassemble, or secure the blade between forked hinge assemblies which can hide food residue even after the blade is detached. A need therefore exists for a food cutting device which has a detachable cutting wheel which can be quickly disassembled to allow access to all accumulated food residue, and then easily reassembled for further use or storage.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a device for cutting food items which is capable of being disassembled and reassembled to facilitate cleaning of accumulated food residue. Accordingly, the present disclosure provides a food cutting device comprising a handle and a detachable cutting wheel, the detachable cutting wheel having a circular blade and an axle, the handle having a retaining pincer adapted to grasp the axle and rotatably retain the detachable cutting wheel, the retaining pincer having a pincer gap which allows the axle of the detachable cutting wheel to be alternatively inserted into or removed from the retaining pincer. Removal of the detachable cutting wheel exposes the accumulated food residue on the retaining pincer and the axle of the detachable cutting wheel.

It is another aspect of an example embodiment in the present disclosure to provide a device for cutting food items with snap-fit assembly and disassembly. Accordingly, the present disclosure provides a retaining pincer having a pair of curved prongs adapted to close around the axle of the detachable cutting wheel and exert an inward biasing force, thus preventing the detachable cutting wheel from being dislodged through the pincer gap without overcoming the inward biasing force.

It is yet another aspect of an example embodiment in the present disclosure to provide a device for cutting food items which protects the hand of a user while the device is in use. Accordingly, the handle has an upper blade guard and a lower blade guard which protect the user's thumb and fingers from the circular blade.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
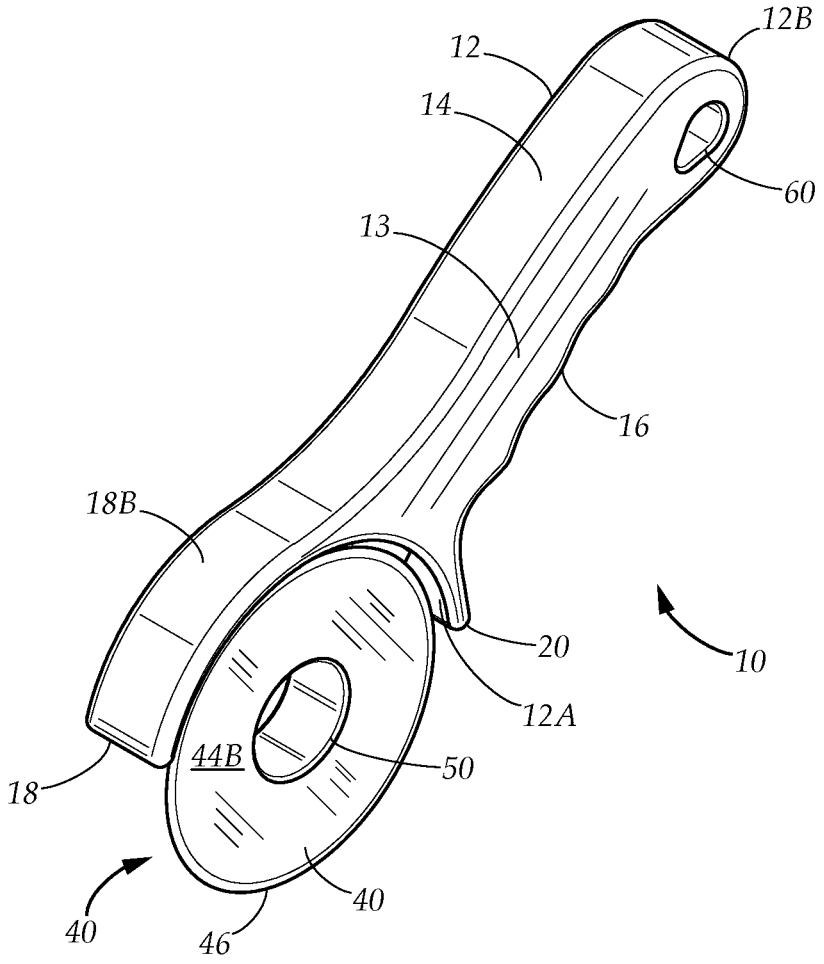
FIG. 1 is diagrammatical perspective view of a food cutting device having a handle and a detachable cutting wheel, in accordance with an embodiment in the present disclosure.
Figure 2:
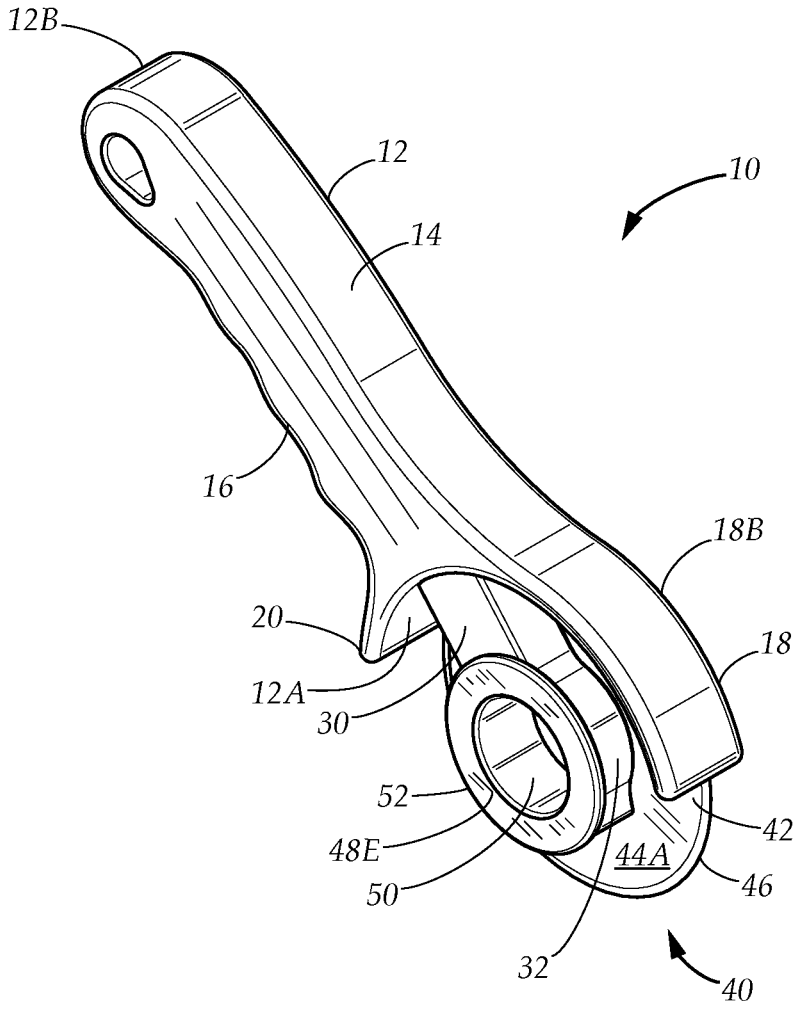
FIG. 2 is a diagrammatical perspective view of the food cutting device from another angle, further depicting a support arm which extends from the handle and terminates in a retaining pincer which is configured to rotatably retain the detachable cutting wheel, in accordance with an embodiment in the present disclosure.
Figure 4:
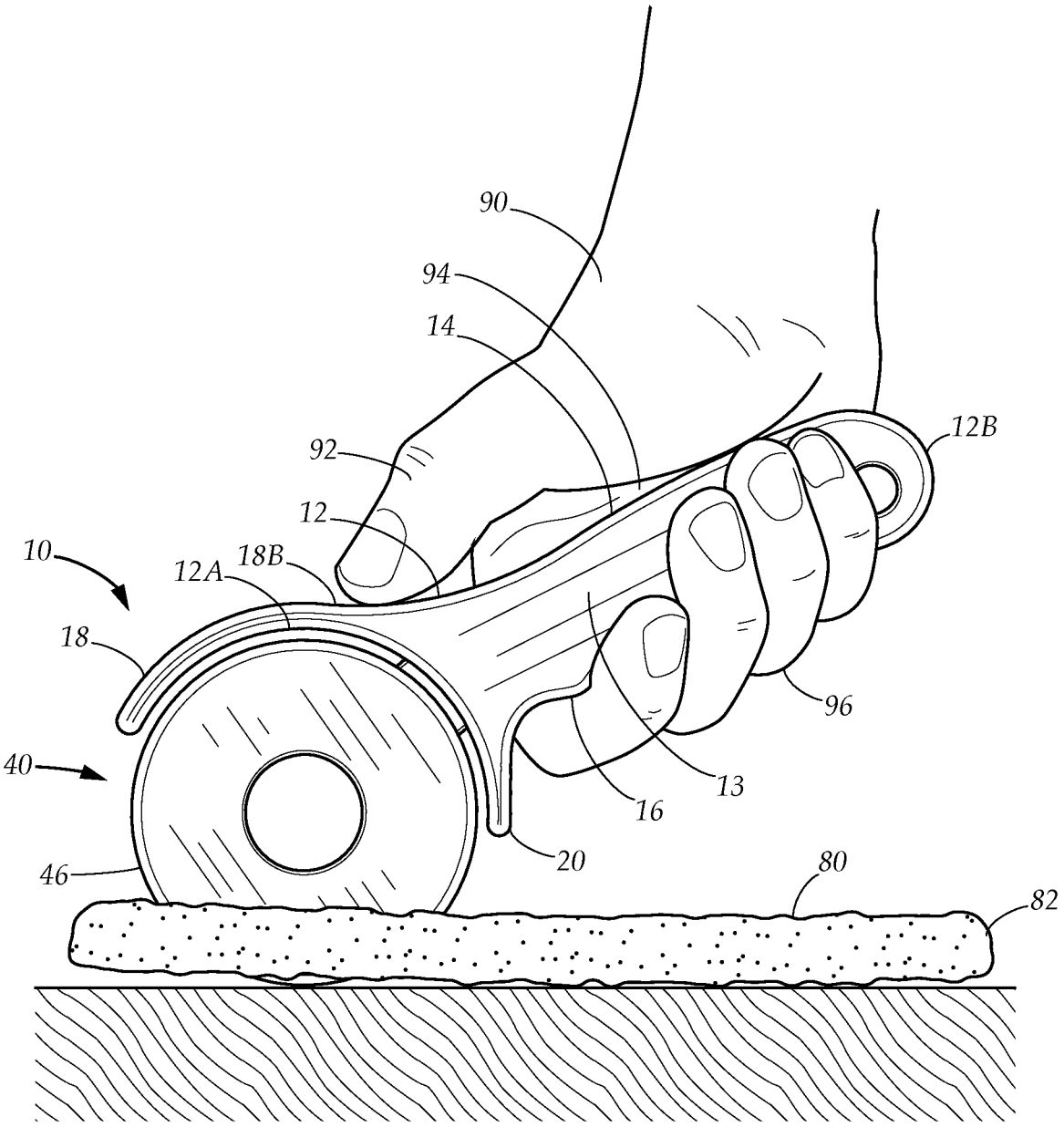
FIG. 4 is a diagrammatical side view showing the food cutting device being held in a user's hand, whereby the cutting wheel is employed to cut a food item, in accordance with an embodiment in the present disclosure.

FIGS. 1-2 illustrate a food cutting device 10 comprising a handle 12 and a detachable cutting wheel 40. The handle 12 has a first end 12A, a distally oriented second end 12B, and a gripping region 13 formed therebetween. Referring to FIG. 2, the handle 12 further has a support arm 30 which is attached to, and projects forwardly from, the first end 12A of the handle. The support arm 30 may be continuous with the handle 12, or may constitute a separate part. The support arm 30 has a retaining pincer 32 which is oriented distally from the first end 12A of the handle 12, which is adapted to detachably and rotatably retain the detachable cutting wheel 40. Referring to FIG. 4, the handle 12 allows the food cutting device 10 to be grasped by a user's hand 90. The food cutting device 10 is positioned above a food item 80, such as a pizza, so that the detachable cutting wheel 40 and the first end 12A of the handle 12 are pointed downwardly towards the food item 80 while the second end 12B of the handle 12 is directed away from the food item 80. The food cutting device 10 is used to cut a food item 80 by rolling the detachable cutting wheel 40 over the food item 80. By separating the detachable cutting wheel 40 from the handle 12, any accumulation of food residue between the handle 12 and the detachable cutting wheel 40 may be easily removed.

Figure 3:
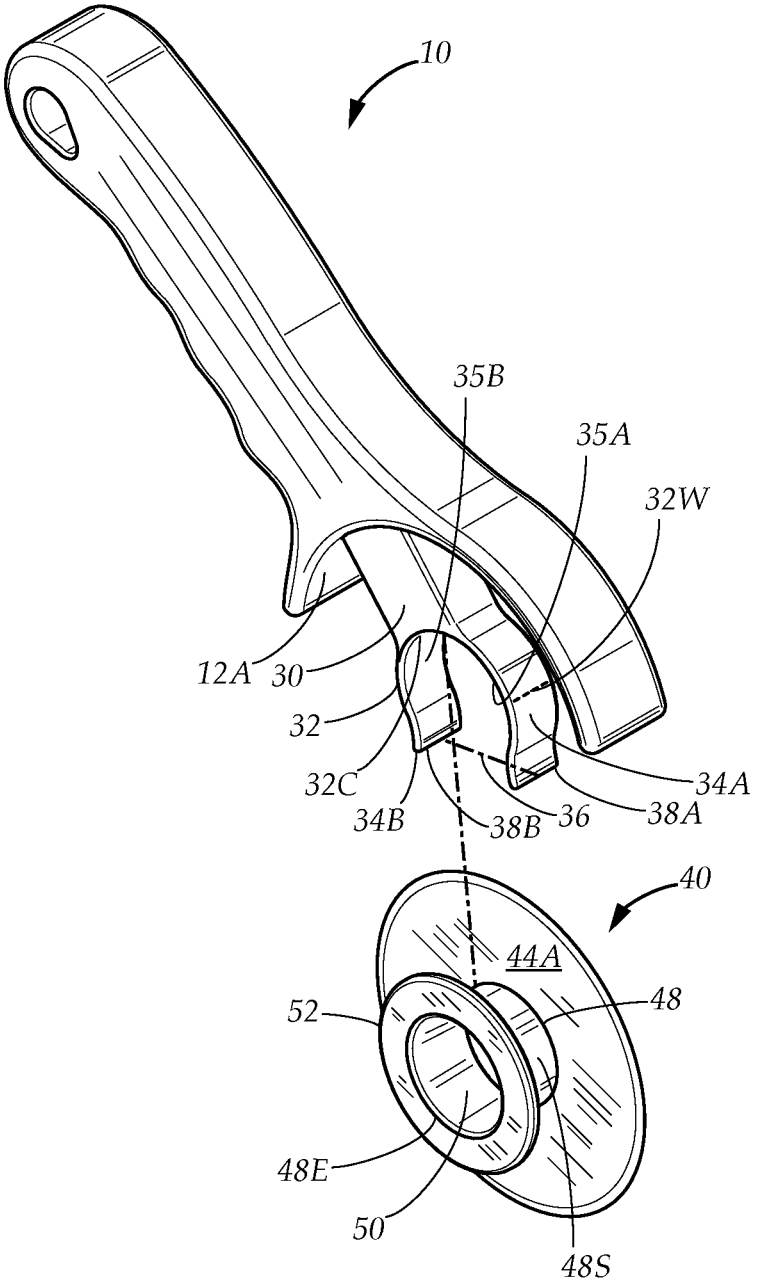
FIG. 3 is a diagrammatical exploded view showing the cutting wheel detached from the handle and the retaining pincer, further depicting an axle which extends from the cutting wheel, whereby the retaining pincer detachably grips the axle while allowing the cutting wheel to rotate about the axle, in accordance with an embodiment in the present disclosure.

Referring to FIG. 3 while also referring to FIGS. 1-2, the detachable cutting wheel has a circular blade 42 with a circumference, and a cutting edge 46 formed around the circumference of the circular blade 42. The circular blade 42 further has an inner face 44A, an outer face 44B disposed opposite the inner face 44A, and a centrally positioned cylindrical axle 48 which projects perpendicularly away from the inner face 44A. The axle 48 has an axle end 48E positioned distally from the inner face 44A of the circular blade 42, and an axle surface 48S disposed between the axle end 48E and the inner face 44A of the circular blade 42. The axle 48 also has a retention flange 52 which extends outwardly from the axle end 48E and is parallel with the circular blade 42.

The retaining pincer 32 of the support arm 30 has a pair of curved prongs comprising a first prong 34A and a second prong 34B. The first and second prongs 34A, 34B have a first tip 38A and a second tip respectively 38B, the first and second prongs 34A, 34B initially project outwardly away from the support arm and then curve inwardly towards each other to form a retaining arc 32C between the first and second prongs 34A, 34B. The first tip 38A and the second tip 38B are separated by a pincer gap 36 which provides access to the retaining arc 32C. The first and second tips 38A, 38B and the pincer gap 36 are oriented downwardly. In certain embodiments, the first and second tip 38A, 38B curve outwardly at the pincer gap 36 to facilitate the deflection of the first and second prongs 34A, 34B during the insertion of the axle 48 through the pincer gap 36.

The retaining arc 32C is adapted to receive the axle 48 of the detachable cutting wheel 40 through the pincer gap 36. In a preferred embodiment, the pincer gap 36 has a width, corresponding to the distance between the first and second tips 38A, 38B, which is smaller than the diameter of the axle 48. The first and second prongs 34A, 34B are formed using a material, such as plastic or metal, which is capable of flexing and deflecting, which allows the first and second tips 38A, 38B to deflect outwardly when the axle 48 is placed within the pincer gap 36, thus increasing the width of the pincer gap 36 and allowing the detachable cutting wheel 40 to be inserted into the retaining arc 32C. Once the axle 48 has passed through the pincer gap 36, the first and second prongs 34A, 34B flex inwardly, causing the retaining arc 32C to close around the axle surface 48S. Once enclosed within the retaining arc 32C, the axle 48 is oriented transversely in relation to the handle 12. In a preferred embodiment, the first and second prongs 34A, 34B have a first prong inner surface 35A and a second prong inner surface 35B respectively. The first and second prong inner surfaces 35A, 35B face inwardly and contact the axle surface 48S when the axle 48 is enclosed within the retaining arc 32C.

The retaining arc 32C allows the detachable cutting wheel 40 to freely rotate about the axle 48 while enclosed therein. In a preferred embodiment, the retaining arc 32C has a diameter which is substantially equal to or less than the diameter of the axle 48 of the detachable cutting wheel 40. When the diameter of the retaining arc 32C is less than the diameter of the axle 48, the presence of the axle 48 within the retaining arc 32C may therefore cause the first and second prongs 34A, 34B to deflect slightly. Tension within the first and second prongs 34A, 34B causes the first and second prongs 34A, 34B to produce an inwardly directed biasing force when deflected outwardly, thereby preventing the detachable cutting wheel 40 being dislodged from within the retaining arc 32C without first overcoming the inward biasing force. Furthermore, in order for the detachable cutting wheel 40 to be detached from the retaining pincer 32, the first and second prongs 34A, 34B must be deflected outwardly to sufficiently widen the pincer gap 36 to allow the axle 48 to pass through. To facilitate the detaching of the detachable cutter wheel 40, the axle 48 may have a hollow space 50 passing axially from the circular blade 42 to the axle end 48E, which allows the user to grasp the detachable cutter wheel 40 without contacting the circular blade 42. Referring to FIGS. 3 and 4, the user may remove the detachable cutter wheel 40 by placing a finger 96 within the hollow space 50, and then pulling the detachable cutter wheel 40 through the pincer gap 36 with enough force to deflect the first and second prongs 34A, 34B.

Referring to FIGS. 3 and 4, when the detachable cutting wheel 40 is rolled across the food item 80, the axle 48 is pushed upwardly away from the pincer gap 36, allowing the axle 48 to remain firmly retained within the retaining arc 32C. Furthermore, the retention flange 52 positioned at the axle end 48E prevents the detachable cutting wheel 40 from shifting laterally within the retaining arc 32C as it is rolled across the food item 80. In a preferred embodiment, the retaining pincer 32 has a pincer width 32W, as measured transversely across the first and second prongs 34A, 34B, which is substantially equal to the distance between the retention flange 52 and the inner face 44A of the circular cutting blade 42. Any lateral shifting of the axle 48 within the retaining arc 32C may therefore be limited by abutment between the first and second prongs 34A, 34B and the inner face 44A of the circular cutting blade 42, and/or the retention flange 52.

Referring to FIGS. 1 and 4, the gripping region 13 of the handle 12 further has a palm surface 14 extending along the gripping region 13 which is adapted to contact the palm 94 of the user's hand 90, and a plurality of finger grips 16, disposed opposite the palm surface 14, which are adapted to engage the user's fingers 96. When the food cutting device 10 is in use and is held over the food item 80, the palm surface 14 is oriented upwardly. In a preferred embodiment, the handle 12 also has an upper blade guard 18 which projects away from the first end 12A of the handle near the palm surface 14. The upper blade guard 18 is curved to conform to the shape of the detachable cutting wheel 40, and is adapted to prevent the user's hand 90 from contacting the cutting edge 46. The upper blade guard 18 also has an upwardly oriented blade guard thumb surface 18B, disposed opposite the detachable cutting wheel 40, which is adapted to allow the user's thumb 92 to be placed thereon, further allowing the user to exert a downward force to assist in the cutting of the food item 80 by pressing against the guard thumb surface 18B using the user's thumb 92.

The handle 12 may further have a lower blade guard 20 which projects away from the first end 12A of the handle near the finger grips 16, in a direction opposite from the upper blade guard 18. The lower blade guard 20 is adapted to prevent the user's fingers 96 from contacting the cutting edge 46, and may also be curved to conform to the shape of the detachable cutting wheel 40.

Figure 5:
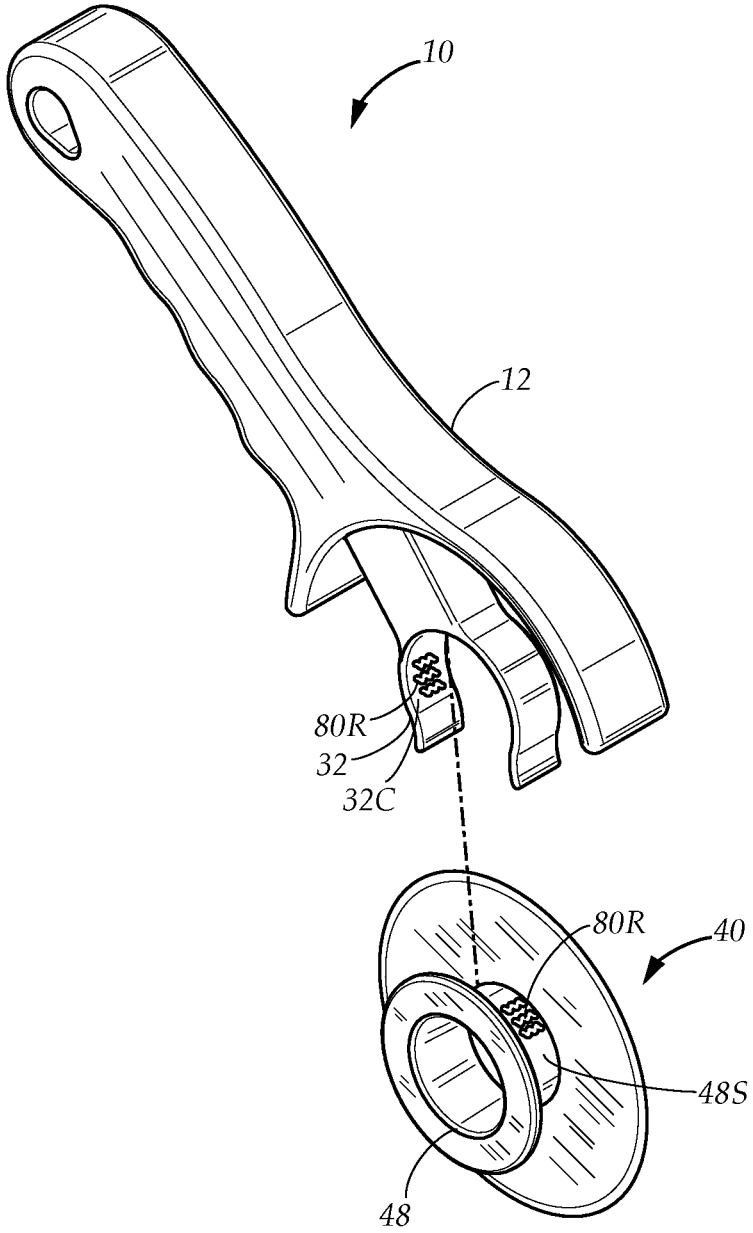
FIG. 5 is a diagrammatical exploded view of the disassembled food cutting device, exposing food residue which has accumulated in the pincer arc as well as on the axle 48 of the detachable cutting wheel, in accordance with an embodiment in the present disclosure.

Referring to FIG. 5 while also referring to FIG. 4, once the food cutting device 10 has been used to cut the food item 80, food residue 80R may accumulate on or around the detachable cutting wheel 40 and the retaining pincer 32, and in particular, between the retaining arc 32C and the axle surface 48S of the detachable cutting wheel 40. Removal of the detachable cutting wheel 40 directly exposes the detachable cutting wheel 40, the retaining arc 32C, the axle surface 48S, as well as the accumulated food residue 80R, thus allowing the food residue 80R to be directly accessed and easily cleaned. The handle 12 and the retaining pincer 32 may be cleaned separately from the detachable cutting wheel 40, thus preventing the user from accidentally contacting the cutting edge 46. Once the food residue 80R has been removed, the detachable cutting wheel 40 is reattached to the retaining pincer 32.

Returning to FIG. 1, the handle 12 may have a hanger hole 60 which passes through the handle 12 proximate to the second end 12B, which allows the food cutting device to be stored on a hook or other similar storage implement.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a food cutting device with a detachable cutting wheel. The disclosure is illustrated by example in the drawing figures, and throughout the written description. It should be understood that numerous variations are possible, while adhering to the inventive concept. Such variations are contemplated as being a part of the present disclosure.

What is claimed is:

1. A food cutting device adapted to cut a food item, the food cutting device is further adapted to be held by a user, the user having a hand, the hand having a palm, a thumb, and fingers, the food cutting device comprising:

a handle adapted to be held in the hand of the user, the handle having a first end and a distally oriented second end;

a detachable cutting wheel having a circular cutting blade and an axle, the circular cutting blade having an inner face, an outer face, and a cutting edge adapted to cut the food item, the axle having an axle end oriented distally from the circular cutting blade, an axle surface extending between the circular cutting blade and the axle end, a retention flange positioned at the axle end, and a diameter, the retention flange extends outwardly from the axle end and is parallel with the circular cutting blade, the axle projecting away from the inner face; and a support arm which projects forwardly from the first end of the handle, the support arm having a retaining pincer adapted to detachably grasp the axle to rotatably retain the detachable cutting wheel, the retaining pincer having a pincer gap opening away from the first end of the handle, a pair of curved prongs comprising a first prong and a second prong, the first prong having a first top and the second prong having a second tip, the first and second prongs project outwardly away from the support arm and then curve inwardly to form a retaining arc between the first and second prongs, the retaining arc is adapted close around the axle surface and allow the detachable cutting wheel to rotate freely therein, the first and second prongs adapted to deflect outwardly to allow the axle to pass through the pincer gap and to exert an inward biasing force when deflected outwardly, the inward biasing force preventing the axle from being dislodged from the retaining arc, the first and second prongs of the retaining pincer further adapted to close around the axle surface between the circular blade and the retaining flange, lateral shifting of the axle within the retaining arc is limited by abutment between the first and second prongs of the retaining pincer and either the inner face of the circular blade or the retention flange, the pincer gap is defined between the first and second tips, the pincer gap has a width less than the diameter of the axle, the pincer gap is adapted to allow the axle to be alternatively inserted or removed through the pincer gap or from the retaining arc.

2. The food cutting device as described in claim 1, wherein:

the axle of the detachable cutting wheel has a hollow space passing through the axle from the circular cutting blade to the axle end, the hollow space is adapted to allow the hand of the user to grasp the detachable cutting wheel and pull the detachable cutting wheel through the pincer gap by overcoming the inward biasing force exerted by the first and second prongs of the retaining pincer.

3. The food cutting device as described in claim 2, wherein:

the handle has a palm surface extending along the gripping region adapted to contact the user's palm when the handle is held in the user's hand, and an upper blade guard which projects away from the first end of the handle and is curved to conform to the detachable cutting wheel.

4. The food cutting device as described in claim 3, wherein:

the handle has a plurality finger grips extending along the gripping region positioned opposite the palm surface, the finger grips are adapted to engage with the user's fingers when the handle is held in the user's hand, the handle further having a lower blade guard projecting away from the first end of the handle in a direction opposite the upper blade guard.

5. The food cutting device as described in claim 4, wherein:

the upper blade guard has a blade guard thumb surface positioned opposite the detachable cutting wheel which is adapted to allow the thumb of the user to be placed thereon, further allowing the user to exert a downward force against the blade guard thumb surface when cutting the food item.

6. A method for assisting a user with cutting a food item, the user having a hand, palm, thumb, and fingers, the method comprising the steps of:

providing a food cutting device comprising:

a handle adapted to be held in the hand of the user, the handle having a first end and a distally oriented second end;

a detachable cutting wheel having a circular blade, a cutting edge, and an axle projecting away from the circular blade, the axle having an axle end positioned distally from the cutting blade, an axle surface extending between the axle end and the cutting blade, and a hollow space passing from the axle end through the cutting blade; and a retaining pincer which projects from the first end of the handle, the retaining pincer is adapted to detachably grasp the axle to rotatably retain the detachable cutting wheel, the retaining pincer having a pair of curved prongs comprising a first prong and a second prong, the first and second prongs form a retaining arc adapted to enclose and rotatably retain the axle of the detachable cutting wheel, the retaining pincer having a pincer gap which opens away from the first end of the handle and is adapted to allow the axle to be alternatively inserted or removed;

grasping the handle by the hand of the user;

inserting the axle of the detachable cutting wheel through the pincer gap such that the detachable cutting wheel is rotatably retained by the retaining pincer and the retaining arc closes around the axle surface;

positioning the food cutting device above the food item;

cutting the food item by rolling the cutting edge of the detachable cutting wheel across the food item;

removing the detachable cutting wheel by inserting one of the fingers of the user through the hollow space of the axle and pulling the detachable cutting wheel through the pincer gap; and directly exposing the axle surface of the detachable cutting wheel, and cleaning food residue accumulated on the axle surface.

7. The method as described in claim 6, wherein:

the axle of the detachable cutting wheel has a retaining flange which projects outwardly from the axle end and is perpendicular to the circular blade;

the step of inserting the axle of the detachable cutting wheel further comprises positioning the retaining pincer between the retaining flange and the circular cutting blade; and the step of cutting the food item by rolling the detachable cutting wheel is followed by the step of preventing lateral shifting of the detachable cutting wheel within the retaining arc by abutment of the retaining pincer against the retaining flange and the circular cutting blade while cutting the food item.

8. The method as described in claim 7, wherein:

the handle has an upper blade guard which projects away from the first end and is curved to conform to the detachable cutting wheel, the upper blade guard having an upwardly oriented blade guard thumb surface facing away from the detachable cutting wheel; and the step of cutting the food item further comprises pressing against the blade guard thumb surface using the thumb of the user and exerting a downward force to assist in cutting the food item.

* * * * *